United States Patent [19]

Pepe

[11] Patent Number: 5,012,985

[45] Date of Patent: May 7, 1991

[54] MULTIPLE STATION TURRET WINDING APPARATUS AND METHOD FOR WINDING WIRE ONTO REELS

[75] Inventor: David Pepe, Meriden, Conn.

[73] Assignee: Davis Electric Wallingford Corporation, Wallingford, Conn.

[21] Appl. No.: 561,223

[22] Filed: Jul. 30, 1990

Related U.S. Application Data

[63] Continuation of Ser. No. 335,637, Apr. 10, 1989, abandoned.

[51] Int. Cl.[5] ..... B65H 67/048

[52] U.S. Cl. ..... 242/25 A; 242/18 A

[58] Field of Search ..... 242/25 A, 25 R, 18 A, 242/18 R, 56 A, 56 R

[56] References Cited

U.S. PATENT DOCUMENTS

| | | | |
|---|---|---|---|
| 2,978,194 | 4/1961 | Lloyd et al. | 242/25 A |
| 2,984,425 | 5/1961 | Thayer | 242/18 A |
| 3,152,768 | 10/1964 | Astrom | 242/25 A |
| 3,355,117 | 11/1967 | Gerhardt et al. | 242/18 A |
| 3,559,902 | 2/1971 | Brock | 242/18 A |
| 3,817,116 | 6/1974 | Georgieff | 74/426 |
| 3,901,456 | 8/1975 | Pradier | 242/18 A |
| 4,138,069 | 2/1979 | Bonzo et al. | 242/18 A |
| 4,147,310 | 4/1979 | Harden et al. | 242/25 A |
| 4,291,841 | 9/1981 | Dalrymple et al. | 242/18 A |
| 4,637,564 | 1/1987 | Hallenbeck et al. | 242/25 A |
| 4,708,298 | 11/1987 | Allard et al. | 242/25 A |

FOREIGN PATENT DOCUMENTS

| | | | |
|---|---|---|---|
| 799738 | 8/1958 | United Kingdom | 242/18 A |
| 1069134 | 5/1967 | United Kingdom | 242/25 A |

OTHER PUBLICATIONS

Ferguson Indexing Catalog, pp. 1-2, Ferguson Machine Co., (1980).

*Primary Examiner*—Stanley N. Gilreath
*Attorney, Agent, or Firm*—Pennie & Edmonds

[57] ABSTRACT

A power driven rotary apparatus is disclosed for winding wire onto reels. A power driven turret has four stations, each adapted for receiving and supporting a reel about which wire is to be wound. Each station has a spindle for mounting a reel at a first location corresponding to a predetermined rotational position of the turret. The turret is rotated sequentially and continuously to each position. Means is provided for directing wire to be wound adjacent the reel when it is located at the wire winding positions located at twelve o'clock and nine o'clock respectively. Means is provided for rotating the reel at the second position in a direction adapted for winding the wire thereabout, and means is provided for stopping rotation of the reel after a predetermined amount of wire is wound thereabout. The reel is removed after the predetermined amount of wire is completely wound thereabout. The apparatus is adapted for sequential mounting of reels onto the turret for winding wire thereabout to provide a substantially continuous and sequential wire winding procedure. A method for rapidly winding wire onto these reels is also disclosed.

20 Claims, 10 Drawing Sheets

MULTIPLE STATION TURRET WINDING APPARATUS AND METHOD FOR WINDING WIRE ONTO REELS

This is a continuation of application Ser. No. 07/335,637, filed Apr. 10, 1989, now abandoned.

TECHNICAL FIELD

The present invention relates to an apparatus and method for continuously and successively winding an elongated flexible member onto spools. In particular, the invention relates to a multiple station rotating turret for winding wire onto spools, reels, or the like.

BACKGROUND ART

Wire winding machines for continuously and successively winding wire about reels or spools are known in the art. Such devices are standard equipment for storing and delivering wire and depending upon their size, they are referred to as either "spools" or "reels". For example, spools are generally sized about 6–10 inches in diameter and above this size they are normally referred to as "reels". Both reels and spools are contemplated herein. However, for convenience of illustration, they will generally be referred to herein as "reels".

In general, the wire and the reel are separately supplied to the machine and the winding is accomplished by the machine after which the fully wound reel is removed at the output of the machine. Some machines provide a pair of winders so that when one reel is fully wound the wire may be cut and transferred to an adjacent reel for winding. During the winding process of a given reel, the fully wound reel is discharged automatically or manually and an empty reel is supplied for winding. The cycle is continuously and sequentially repeated.

Wire winding machines of the type described usually operate at extremely high speeds and subject the components to substantial stresses and substantial resulting wear. In particular, the objective of fully winding a plurality of reels with industrial wire with minimum loss of time between reels will necessarily involve substantial load factors due particularly to the repeated action and changes of direction of the components during the loading, winding, transfer and unloading processes.

In a typical machine, empty reels are normally supplied to the machine and positioned and grasped for wire winding. After the wire winding has been completed, the reels are sequentially released and discharged from the machine. In some cases, the fully wound reels are discharged automatically by the output section of the machine. In other cases, the fully wound reels are removed by an operator.

One example of a continuous wire winding machine is disclosed in U.S. Pat. No. 4,637,564. This patent relates to a dual reel continuous wire winding machine with a robotic reel loading mechanism. The continuous wire winding machine has a pair of flanges connected by a central core and a conveyor for supplying empty reels to and removing wound reels from the machine. Two pairs of arbors are provided for gripping and rotating the reels for winding wire thereabout. One of each of the pairs of arbors is driven. A transfer mechanism is provided for transferring empty reels from the conveyor and fully wound reels to the conveyor and includes a pair of robotic arm assemblies. A shaft is provided to mount each robotic arm assembly for oscillation through an arc of 180°. A first gripper is provided for grasping an empty reel at one end of the assembly and a second gripper is provided for grabbing the wound reel at the other end of the assembly. Driving means mounts the grippers for moving them between an outwardly extending position and an inwardly retracted position relative to the assembly and the shaft.

Other examples of such machines are known in the art for winding wire onto reels on a regular basis. None of these devices, however, are capable of providing wound reels of wire at speeds which meet commercial high speed requirements. I have invented an apparatus and method whereby high speed winding is achieved by dividing each reel winding operation into separate steps on a rotating turret mechanism which divides the high speed reel loading and winding process into convenient stations.

A power driven rotary apparatus is disclosed for winding wire onto reels which comprises a power driven turret having at least two stations, each station receiving and supporting a reel about which wire is to be wound. The turret has a generally circular configuration and is mounted for rotation. A reel to be loaded is mounted on a first station in a first position of the turret. The turret is then rotated such that the reel is moved to a second position. The wire to be wound is directed onto the reel when located at the second position, which is rotated to wind the wire onto the reel. Rotation of the reel stops after a predetermined amount of wire has been wound thereon. Reels are sequentially mounted onto the turret to provide a substantially continuous and sequential wire winding procedure.

The turret preferably includes at least four stations, which upon rotation of the turret pass successively through a reel loading position, a wire winding commencement position, a wire winding completion position, and a reel unloading position. Typically, the reel loading position is at three o'clock as viewed from the front of the turret, and the wire winding commencement position is at twelve o'clock. The wire winding completion position is at nine o'clock, and the reel unloading position is at six o'clock.

A motor driven pulley and belt system selectively rotates the reels at the positions for appropriately winding the wire around the reels. The motor driven pulley and belt system comprises two motors, each driving a separate system of pulleys via toothed belts. Each station comprises a rotatable shaft carrying two pulleys, one of which is engaged to the shaft so that it drives the shaft when it is rotated, and the other of which freewheels on the shaft so that it does not drive the shaft when it is rotated. The freewheeling pulleys act as idlers, keeping proper tension on the belt. Each pulley of each pair engages only one motor and belt system as the station at which it is carried moves from position to position. Therefore each separate shaft is driven throughout its movement by a particular motor and belt system. The pulleys on adjacent shafts are arranged so that adjacent shafts are driven by different motor and belt system. The pulleys may be engaged by the belts at the winding commencement and completion positions, and additionally over all or part of the path the pulleys follow when moving between those positions, so that the belts are tensioned at all times and the reels are driven continuously.

BRIEF DESCRIPTION OF THE DRAWINGS

Preferred embodiments of the invention will be described hereinbelow with reference to the drawings wherein.

DETAILED DESCRIPTION OF THE PREFERRED EMBODIMENTS

Figure 1:
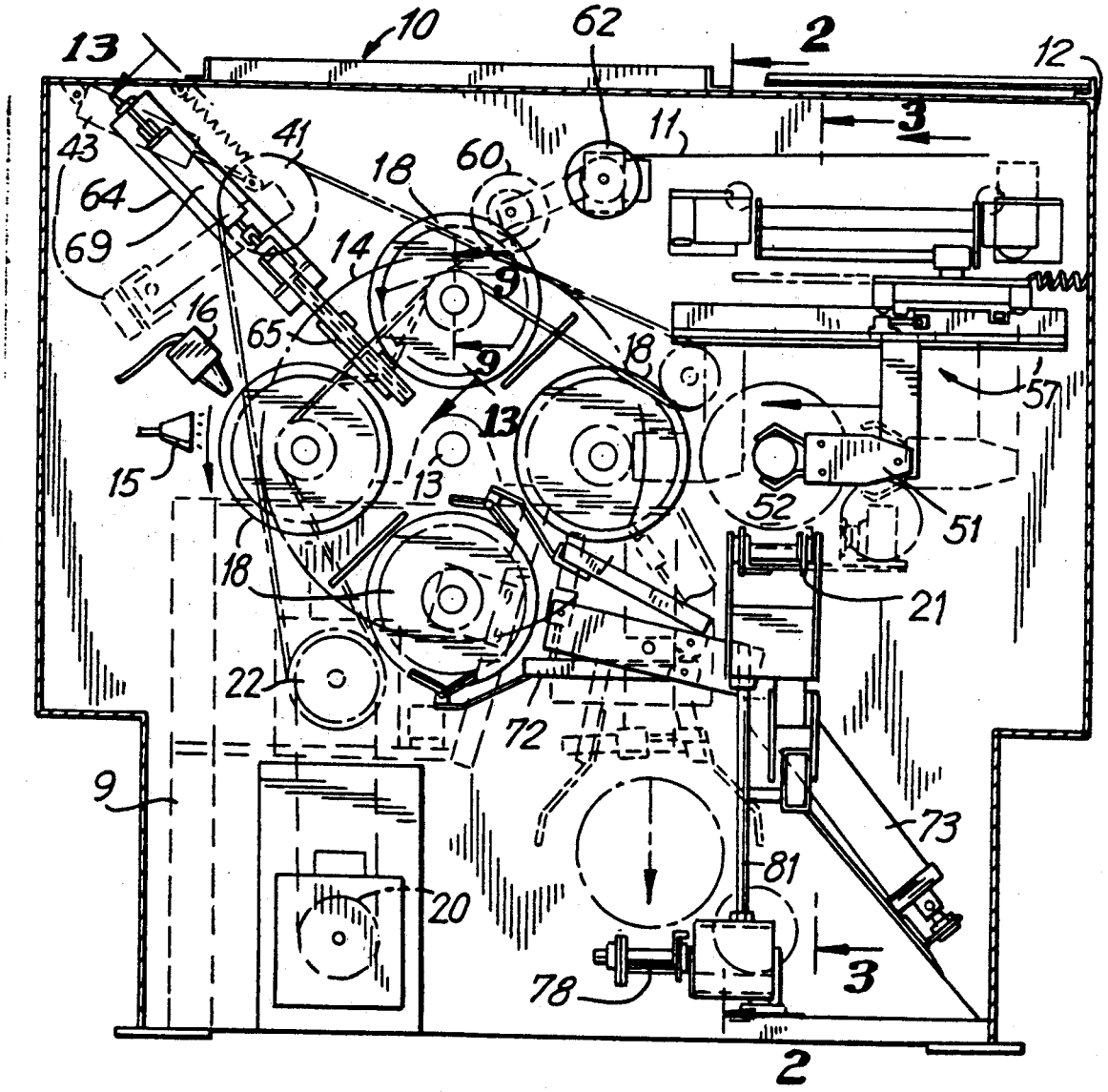
FIG. 1 is a front elevational view of the apparatus of my invention illustrating the housing and the turret winding mechanism.

Referring initially to FIG. 1, the apparatus 10 according to the invention is illustrated. Housing 12 supports the entire mechanism and includes rotating turret 14 which rotates on a shaft 13 in the counterclockwise direction as indicated by the arrow. The turret is disposed in an opening in wall 7, shown in FIGS. 2 and 3. The shaft 13 is supported by support frame 9 and is driven by an indexing drive 8, which thus drives the turret through the shaft. The turret has four stations, each of which includes a shaft mounted for rotation about their respective axes. Each reel-mount station sequentially assumes the positions as shown, namely, three o'clock, twelve o'clock, nine o'clock and six o'clock as viewed in FIG. 1. Any numerous indexing turrets known in the art and employed for such purposes may be used, such as those manufactured by Ferguson Machine Company and disclosed in U.S. Pat. No. 3,817,116. At the three o'clock position, a reel is positioned on the turret and does not begin receiving wire until it arrives at the twelve o'clock position where approximately 70–80 percent of the full predetermined amount of wire is wound onto the reel. The remainder of the wire is wound about the reel when it is at the nine o'clock position. At the end of the cycle—which will be described in further detail hereinbelow—a suitable mechanism 16 is positioned adjacent the nine o'clock position for applying a sealant or glue (with appropriate heat setting if needed), on the loose end of the wire. Thereafter, the reel is rotated to the six o'clock position where it is removed and placed on a conveyor as shown. An empty reel input conveyor and a fully wound reel output conveyor are provided.

Figure 8:
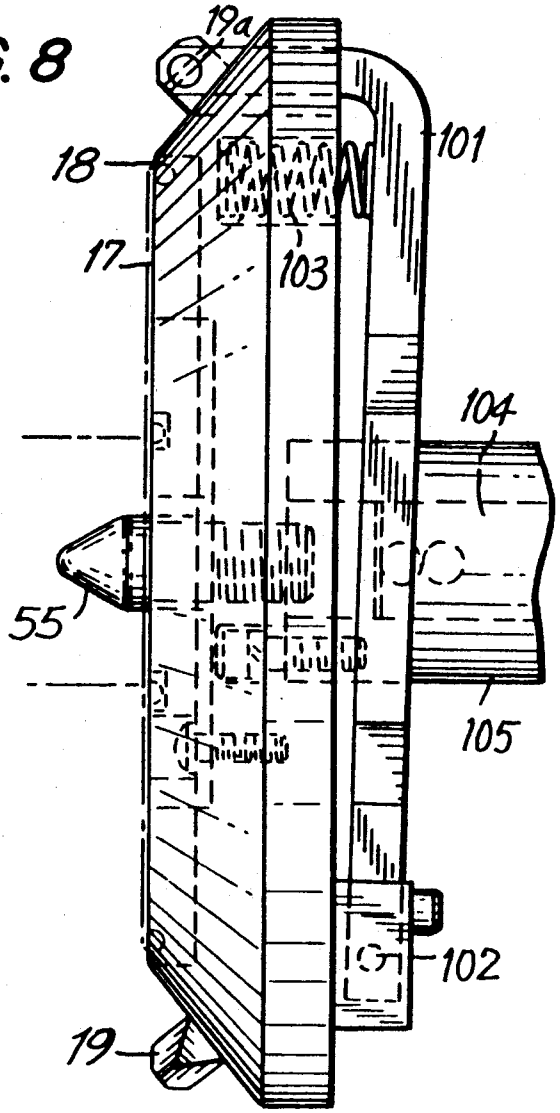
FIG. 8 is a side view of the disc shown in FIG. 7.
Figure 7:
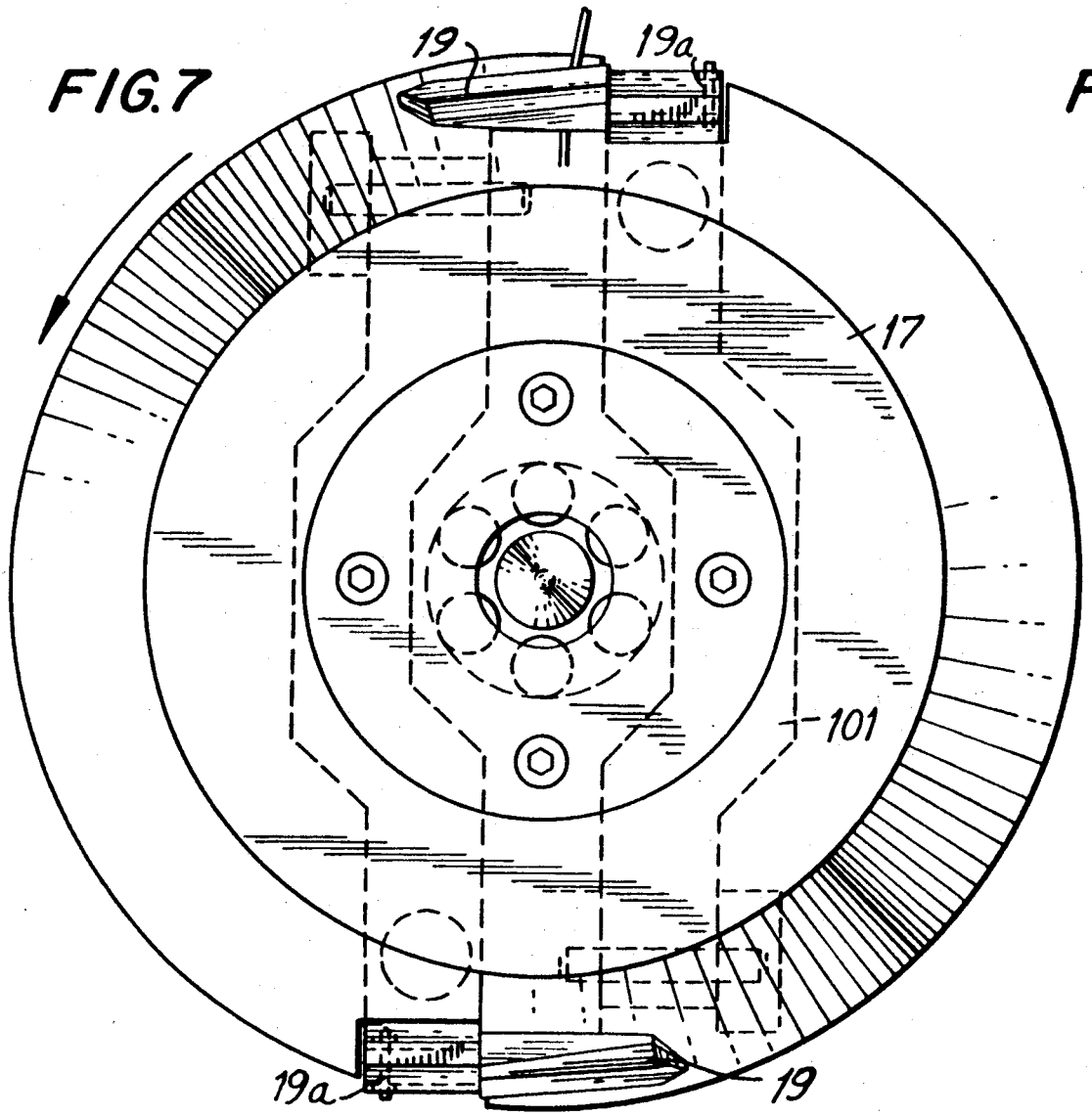
FIG. 7 is a front elevational view of the snagger disc arranged to mount reels about which wire is to be wound.

Having described the general operational principles of the invention, the following is a more detailed description of the apparatus. The four station turret member includes four shaftless air clamped-snagger assemblies 18 with releasing snagger assemblies 19, actuated off the turret for simplicity as shown in FIGS. 7 and 8. The, snagger assemblies 18 include interchangeable pintles 55 and neoprene drive discs 17 in lieu of a drive pin.

Figure 2:
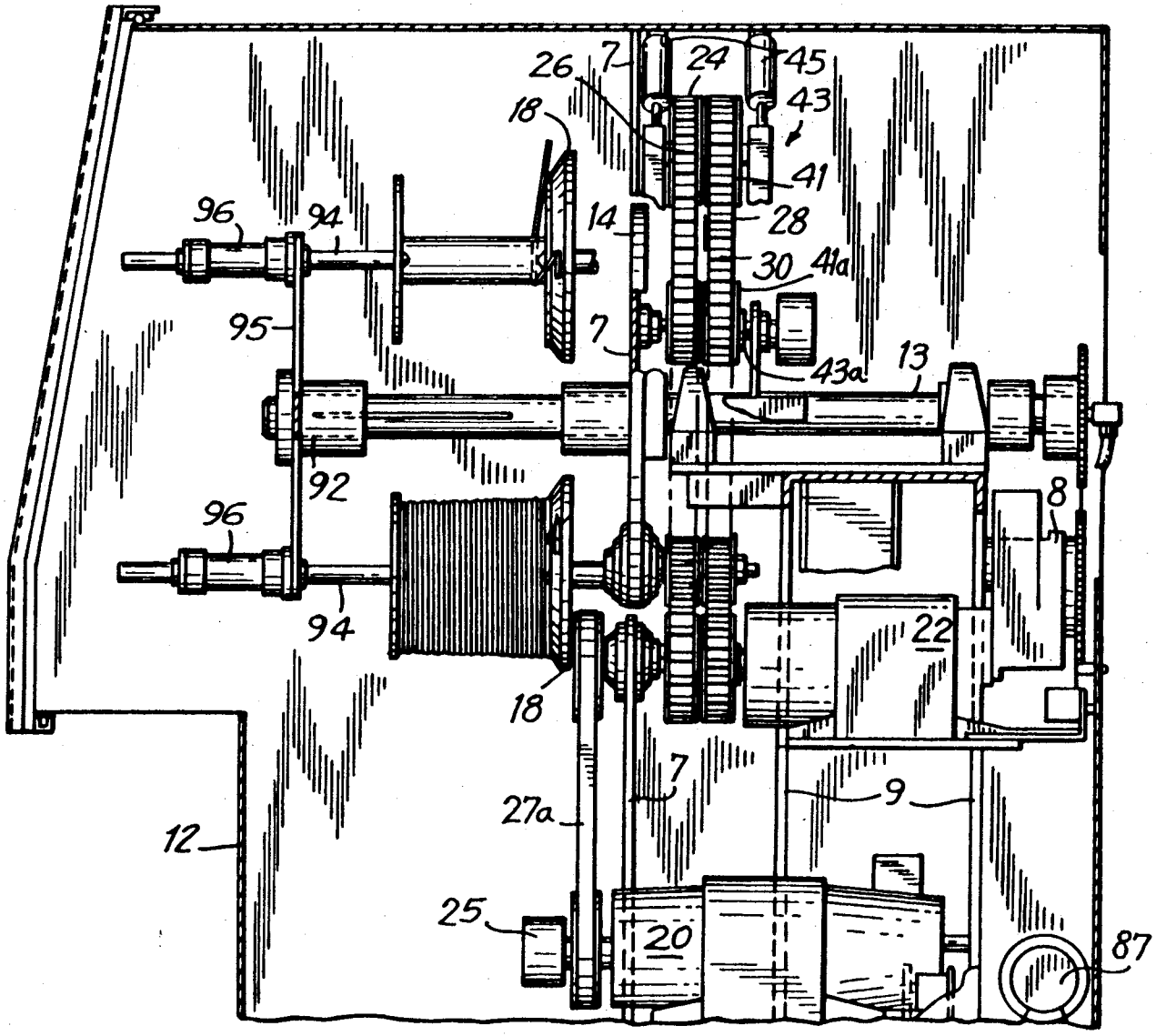
FIG. 2 is a view taken along lines 2—2 of FIG. 1 showing a finished reel at the six o'clock position and a reel on which winding is about to begin at the twelve o'clock position.
Figure 3:
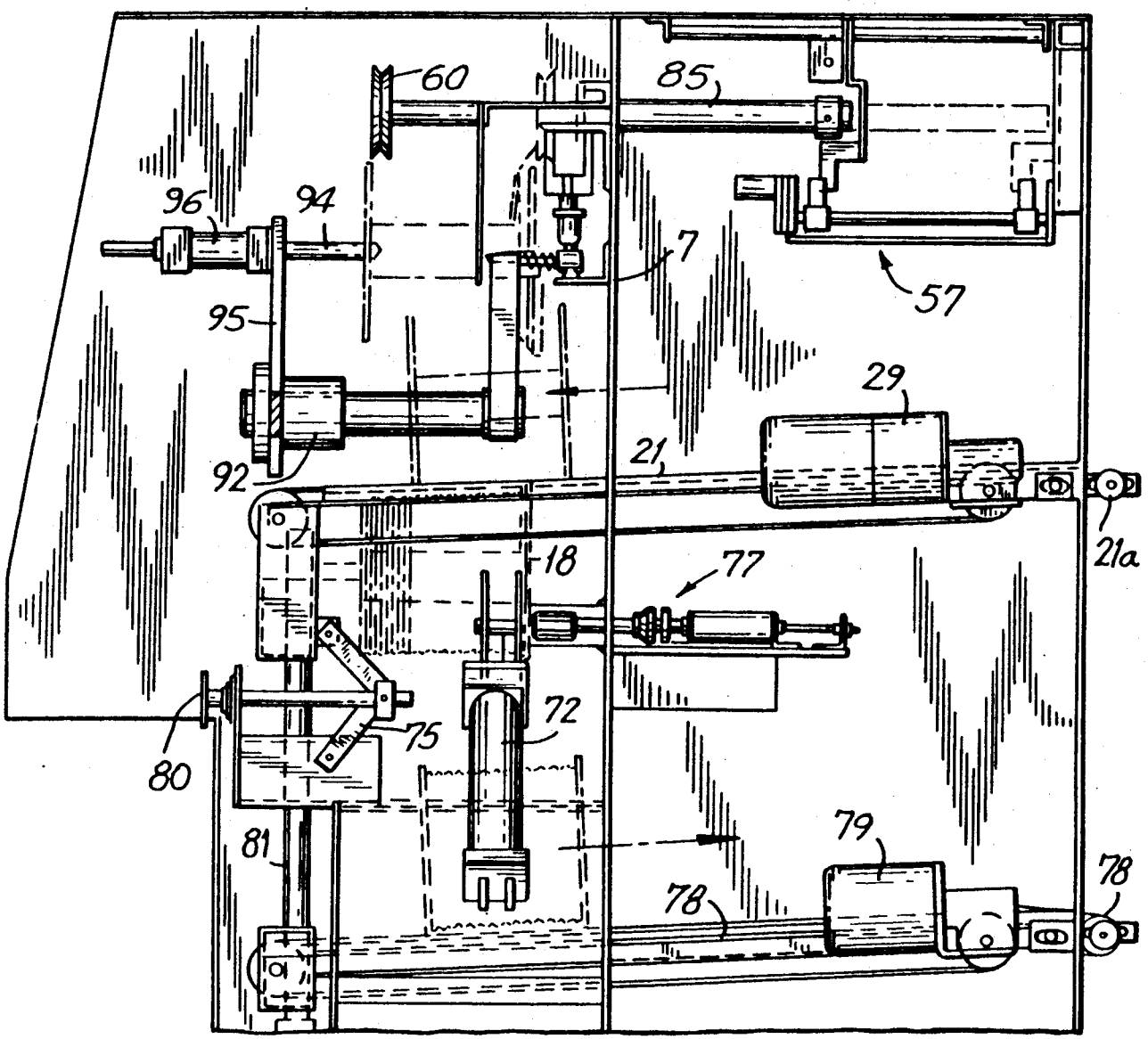
FIG. 3 is a view taken along lines 3—3 of FIG. 1 illustrating the internal mechanism of the apparatus constructed according to the invention, including the loading conveyor and unloading conveyor.
Figure 4:
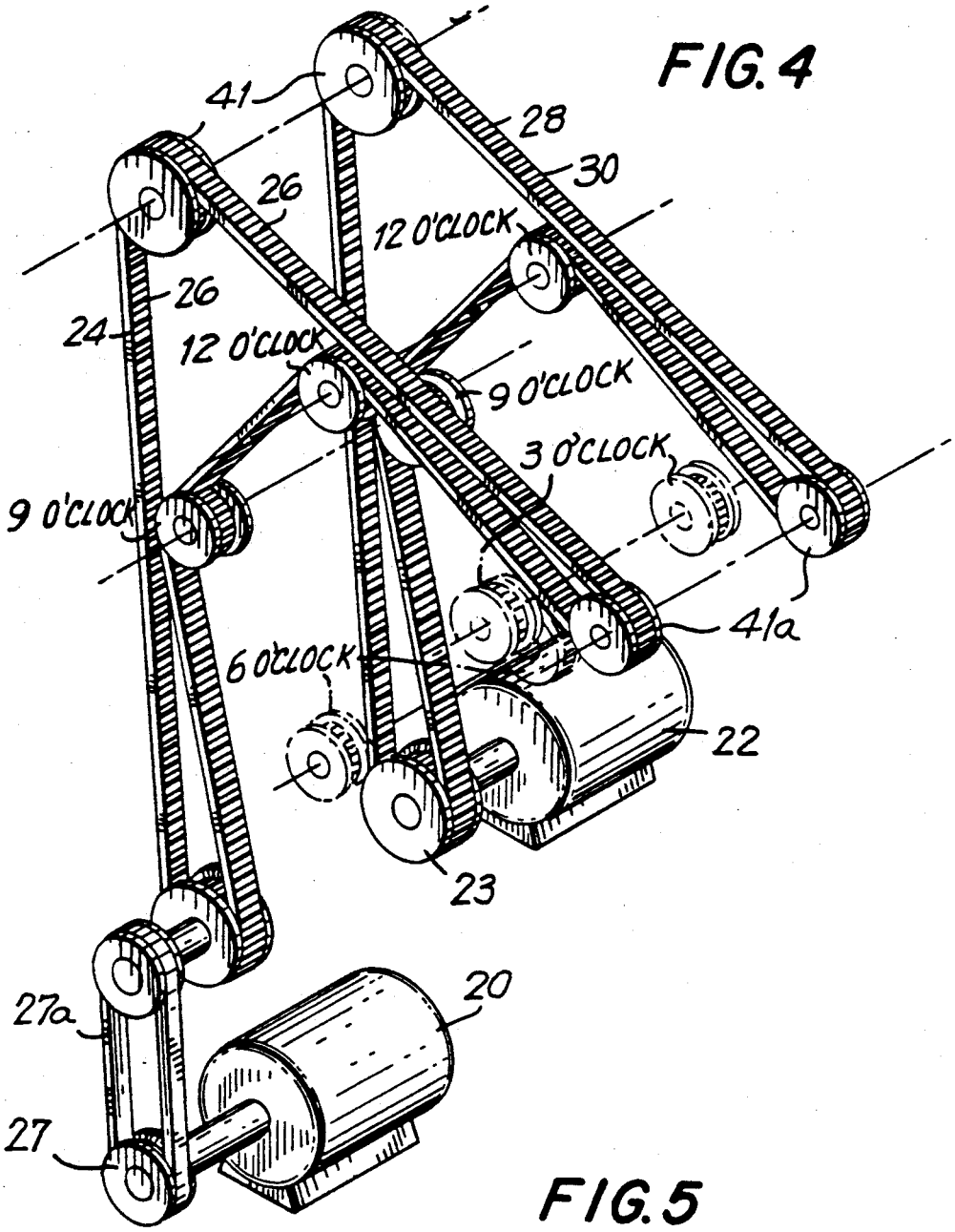
FIG. 4 is a perspective view of the multi-belt pulley drive system constructed according to the invention.

Snaggers 19 are hinged at pins 19*a* and are spring-loaded to remain normally in the closed position. The snaggers are air-clamped in that air pressure from a cylinder is used to open the hinged snaggers at appropriate times as required by the invention. Specifically, the snaggers are opened when the fully would reel is to be removed from the turret at the six o'clock position, and otherwise remain closed to grasp the wire. Winding is initiated by catching the wire on a snagger 19 as an empty reel mounted on pintle 55 rotates. The snagger remains in a closed position until the full reel is to be unloaded from the machine, and the wire must be released. To open the snagger and release the wire, snagger lever 101 is forced inward against spring 103, which normally keeps the snagger closed by urging lever 101 outward. When lever 101 moves inward, snagger 19 is rotated around 19*a*. Lever 101 rotates around hinge 102, and can be forced inwardly at the six o'clock position. Preferably, a movable piston 104 within cylinder 105 is used, with piston 104 arranged to be forced into lever 101 by air pressure when at the six o'clock position. It is possible to use one or two snagger assemblies per drive disk. Using one assembly is preferred for simplicity. There are two motors 20 and 22 (shown clearly in FIG. 2) arranged to drive two separate belt systems which are festooned about the drive system as shown in FIG. 4. The belt systems in turn, rotate the drive discs 17 and the snagger assemblies 18 in the appropriate sequence. Input conveyor 21, driven by conveyor motor 29, delivers empty reels to the turret member which are automatically positioned by automatically operated "IN-LOAD" gripping robotic arm device 51 shown in FIG. 6. The reels are secured against the drive disc 17 by reel clamp pintles 94, which are part of reel clamp assembly 92, as shown in FIGS. 2 and 3. Pintles 55 and reel clamp pintles 94 thus support the reels as the winding process is carried out.

Figure 10:
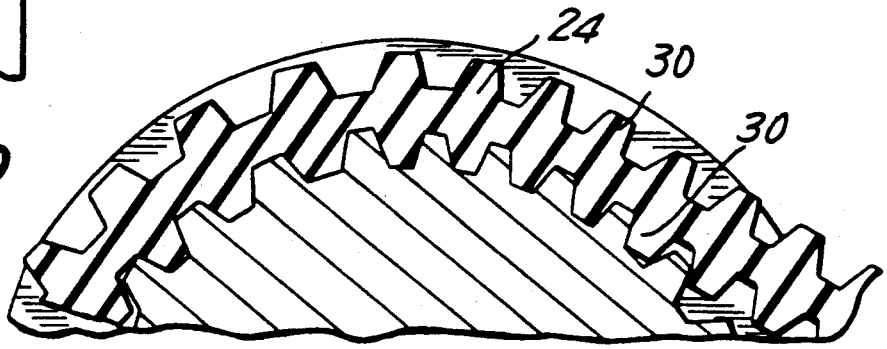
FIG. 10 is a cross-sectional view taken along lines 10—10 of FIG. 9 illustrating one of the double-sided, multi-toothed drive belts of the invention.
Figure 11:
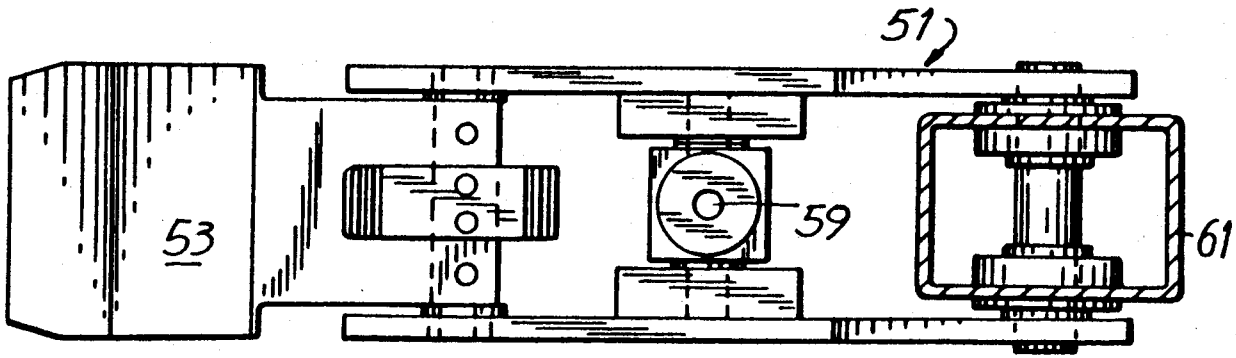
FIG. 11 is a top view of the robotic arm utilized for loading reels.
Figure 12:
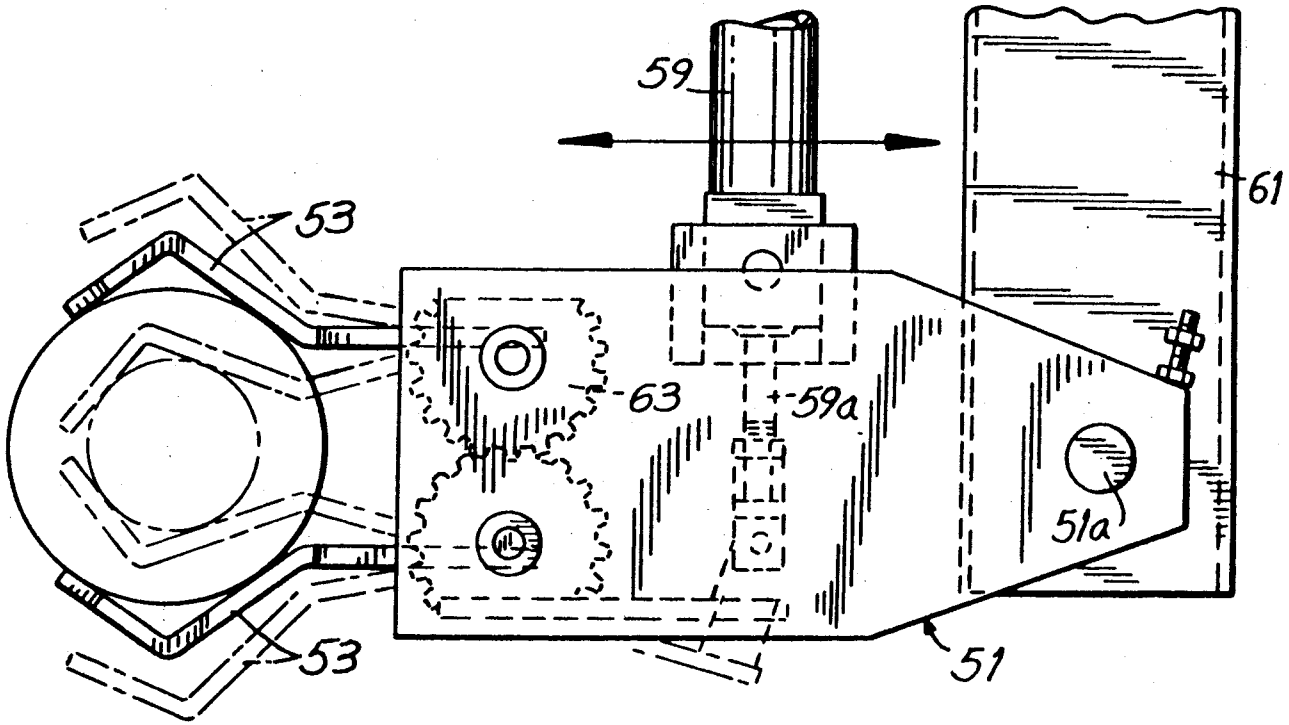
FIG. 12 is a side view of the robotic arm shown in FIG. 11.

Referring to FIGS. 4 and 10, the festooned belt system is illustrated. Front pulley belt 24 has teeth 26 on both sides and rear belt 28 has teeth 30 on both sides. Front belt 24 is driven by lower motor 20 via pulley 27 and drive belt 27*a*, whereas rear pulley belt 28 is driven by upper motor 22 via pulley 23 as shown. A brake 25 as shown to the left of lower motor 20 in FIG. 2 should be provided with each motor. Each belt is festooned such that as turret 14 rotates with reels in position at the three o'clock, six o'clock and nine o'clock positions, the associated drive pulleys located behind the turret will engage the belts as will be seen hereinbelow.

Figure 5:
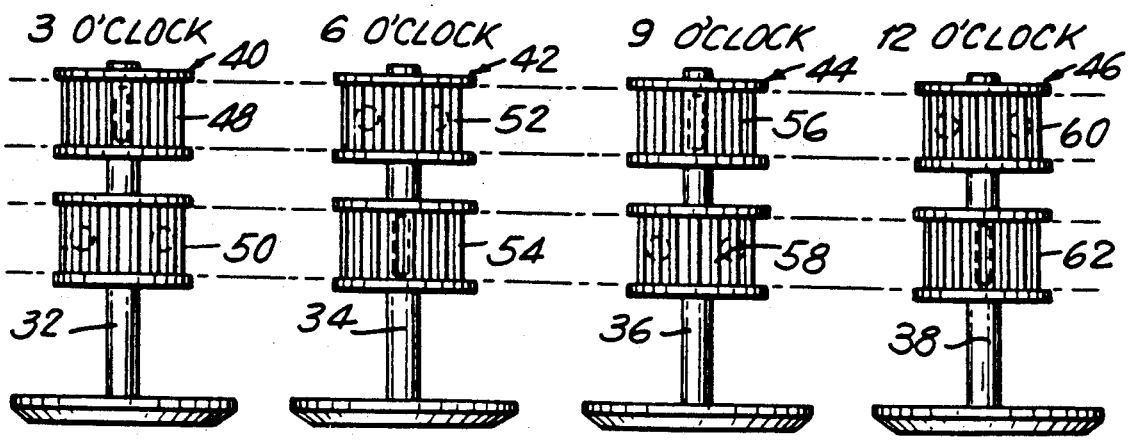
FIG. 5 is a plan view from above of the pulley drive system of the multi-belt drive system for alternately and sequentially rotating reels for winding wire thereabout.
Figure 9:
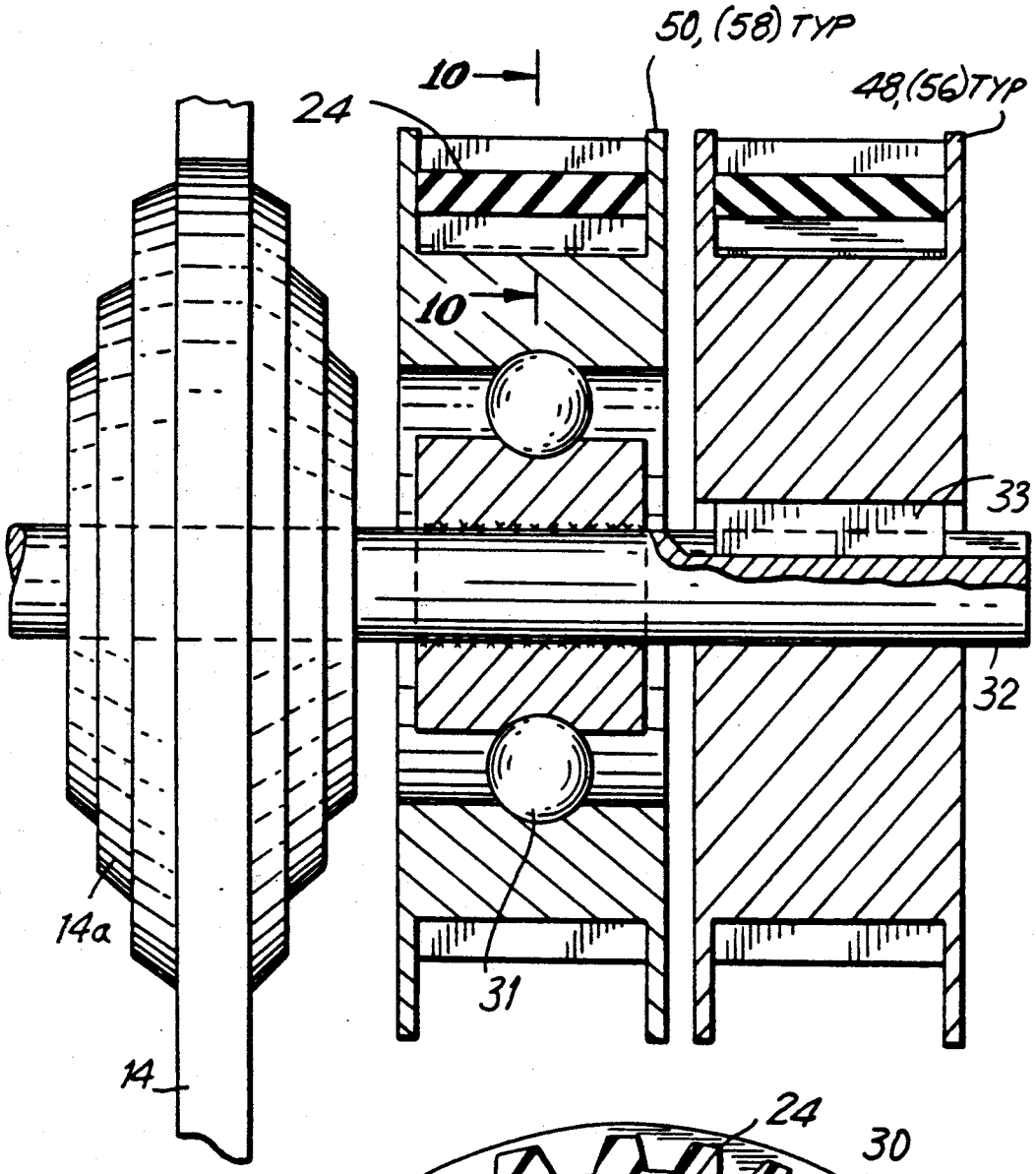
FIG. 9 is a view of the pulley arrangement illustrating the drive connectors for driving the snagger disc.

The belts are each festooned over a series of shafts 32, 34, 36, 38 respectively attached to pulley systems 40, 42, 44 and 46 as shown in FIG. 5. There are two pulleys at each turret station, with one pulley fixed for rotation with the shaft and the other pulley arranged to freewheel with respect to the shaft and the snagger assembly. For example, assembled pulley system 40 includes pulley 48 fixed to rotate with shaft 32, and pulley 50 arranged to freewheel with respect to the shaft 32. FIG. 9 shows pulley system 40, in which outer pulley 48 is drivingly engaged at 33 to shaft 32, while inner pulley 50 freewheels around shaft 32 by virtue of bearings 31. FIG. 9 also shows the relationship of the pulleys and shaft to turret 14 and mounting plate 14*a*. Each next position includes pulleys which are secured oppositely to the respective shafts as compared to the next adjacent shaft. Thus, pulleys 50, 52, 58 and 60 are bearing mounted on their respective shafts as shown, and pulleys 48, 54, 56 and 62 are fixed to rotate with their respective shafts by keys as shown.

According to this arrangement, when the turret is rotated counterclockwise as in FIG. 1 such that pulley system 44 is at the twelve o'clock position the rear pulley belt 28 rotates the shaft via pulley 56 while the front pulley belt 24 freewheels via pulley 58 with respect to shaft 36. Thus, when the turret indexes to the next position with pulley assembly 46 at the twelve o'clock position the front pulley belt 24 drives shaft 38 through pulley 62 and the rear pulley belt 28 freewheels via pulley 60.

The belts are also festooned over idler pulleys 41 and 41*a*, mounted on supports 43 and 43*a*, as shown in FIGS. 1, 2 and 4. Supports 43 for pulleys 41 include air cylinders 45 which absorb shock and take up slack. As the turret 14 rotates counterclockwise as shown in FIG. 1, each reel-mount station stops successively at positions three o'clock, twelve o'clock, nine o'clock and six o'clock as viewed in this FIG. The turret rotates incrementally in 90 degree movements. At the three o'clock position for reel loading, pneumatic robotic assembly 51 supplies an empty reel as shown. The robotic assembly automatically advances to the left of FIG. 1 so as to position the reel 52 on the pintle 55 at the three o'clock position of the turret. The reel is clamped into position by one of pintles 94, shown in FIG. 2, which are connected to double-rod-end cylinders 96, all of which are mounted on support member 95. This whole pintle assembly 92 is mounted on the turret shaft 13, and rotates with the turret. Each pintle is controlled by cylinders 96 to clamp an empty reel when at the three o'clock position, and remain clamped until the six o'clock position where the reel is released.

While an empty reel is positioned at the three o'clock position, the reel positioned at the twelve o'clock position is accelerated and brought up to rotational speed and begins winding. Meanwhile, the reel which has moved to the nine o'clock position has completed its winding sequence. In fact, during the time that the reel from the three o'clock position is rotated with the turret to the twelve o'clock position, the reel which has moved to the nine o'clock position—from the twelve o'clock position—is completing its winding process. At the end of this winding, the finger/cutter assembly, which is powered by an air cylinder 69, 64 will be automatically sequenced to rotate toward the path of the wire shown in FIG. 13 to thereby push the wire 11 into the path of the snagger of the empty reel located at the twelve o'clock position. Meanwhile, the reel at the twelve o'clock position which has been rotating, then causes the wire to be pulled downwardly into the path of knife 66 so as to thereby cut the wire 11. Simultaneously with this action, the remaining wire now begins to be wound about the next reel at the twelve o'clock position. Once the wire is transferred by this sequence of operations, the next winding sequence is started on the reel now located at the twelve o'clock position.

Figure 6:
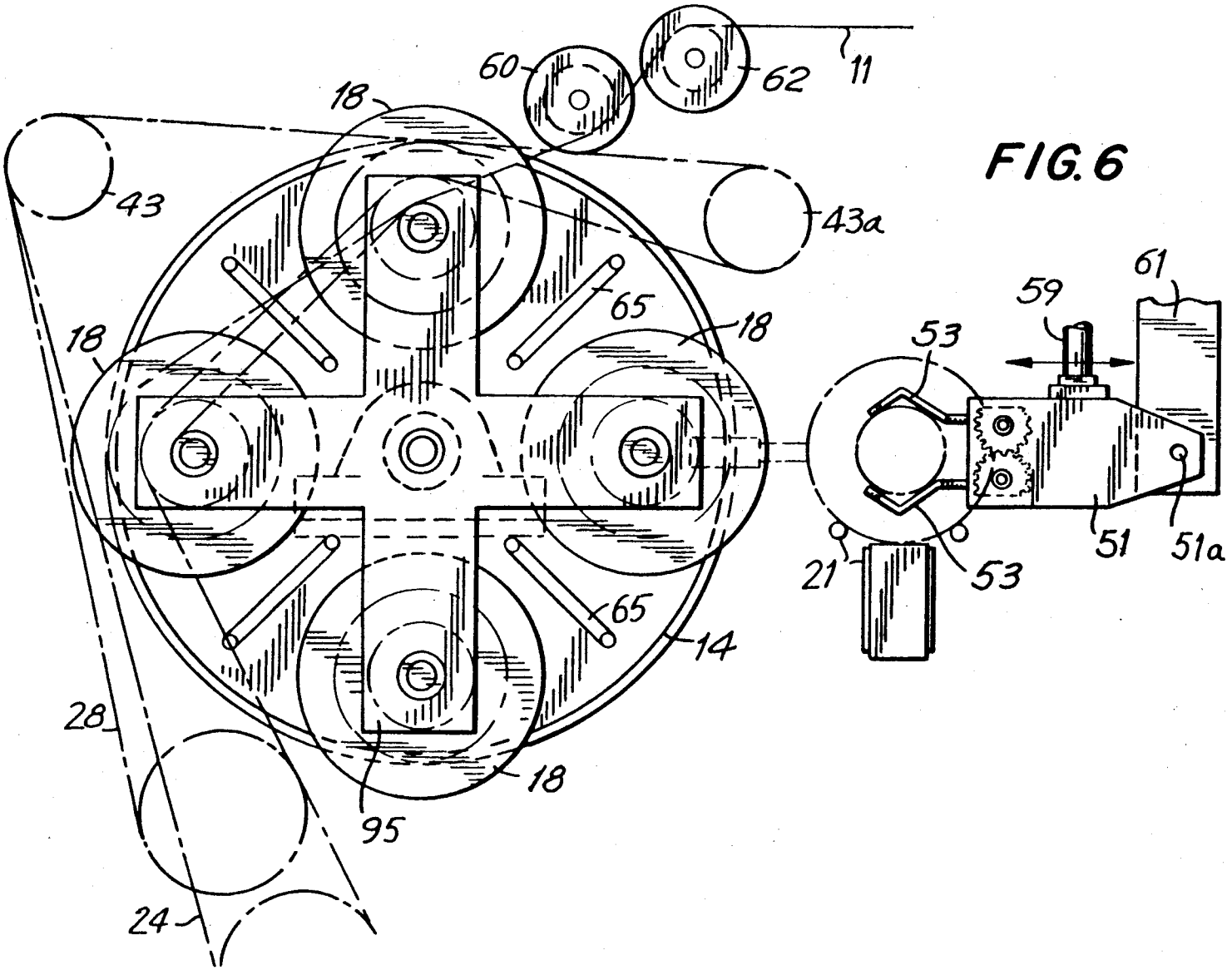
FIG. 6 is a front schematic view of the robotic loading system and the turret winding and wire feeding supply system.

The belt driven pulley accelerates to speed until the core of the reel has the same velocity as the wire 11 which is fed by guide sheaves 60 and 62 shown in FIGS. 1 and 6. The guide sheaves operate as a traverse to distribute the wire back and forth over the reel, in order to evenly wind the wire. The movement of the sheaves, shown in FIG. 3 by a phantom and a full depiction of sheave 60, is synchronized with the speed of the reel, and is controlled by hydraulic cylinder 85. Cylinder 85 is powered by motor 87 shown in FIG. 2, which is connected to cylinder 85 in a conventional manner. As can be seen in FIGS. 1 and 6, the wire leaving the guide sheaves 60 and 62 is directed to the reel at the twelve o'clock position. Thus, the wire winding process takes place at the twelve o'clock position as the reel is rotated counterclockwise as shown in FIG. 1. When a predetermined length of wire has been wound about the reel at the twelve o'clock position (i.e. 70–80 percent), the turret is indexed 90 degrees in the counterclockwise direction so that the reel previously at the twelve o'clock position is now located at the nine o'clock position and is rotated by the action between belt 28, pulley 56 and shaft 36. At this location, the reel is almost completely wound except for the remaining 20–30 percent of the wire which is then wound onto the reel. Thus, at this location, the winding process is essentially completed.

Figure 13:
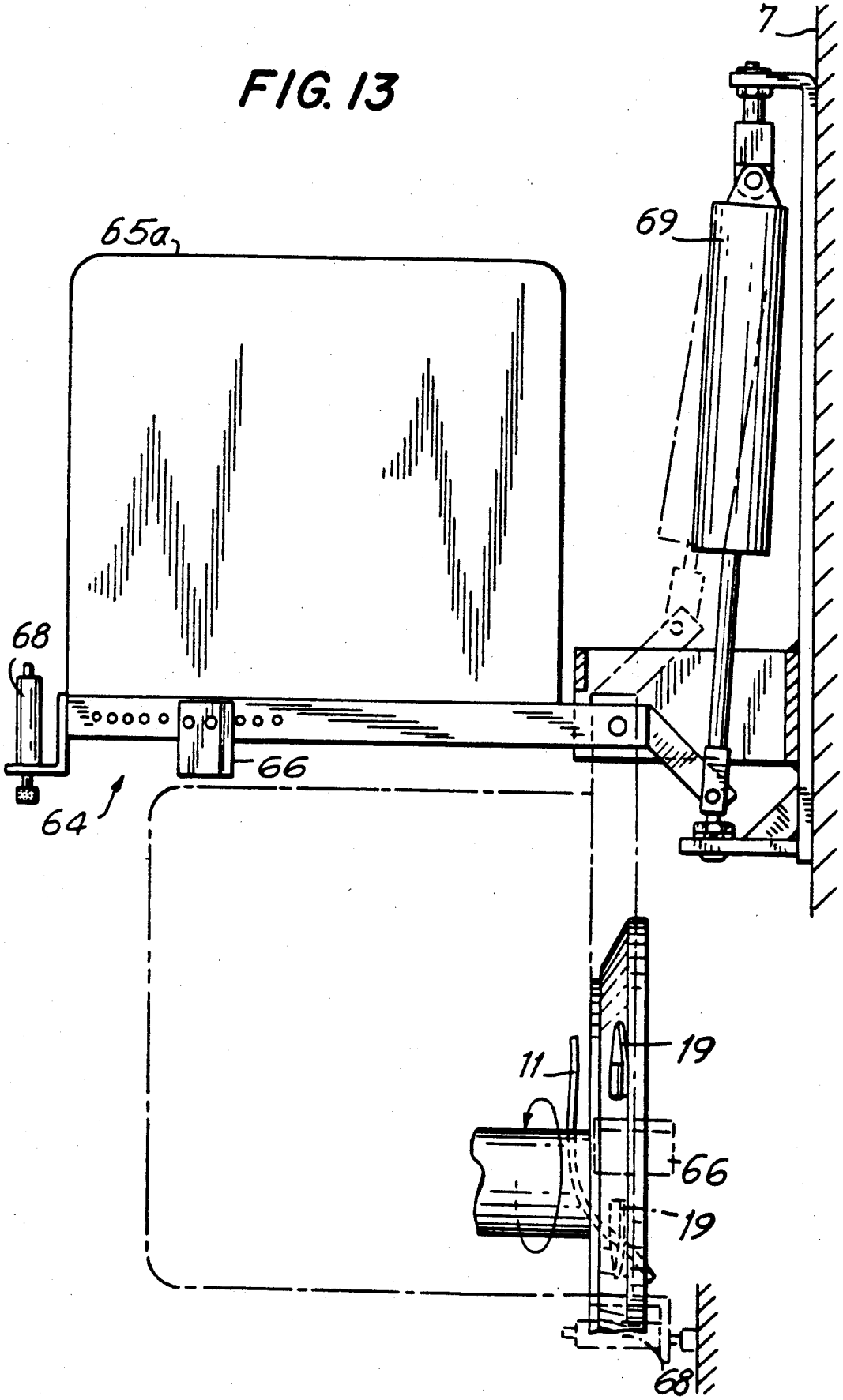
FIG. 13 is a view taken along lines 13—13 of FIG. 1 illustrating a wire cutting knife shown in the home position and shown in phantom in the cutting position.
Figure 14:
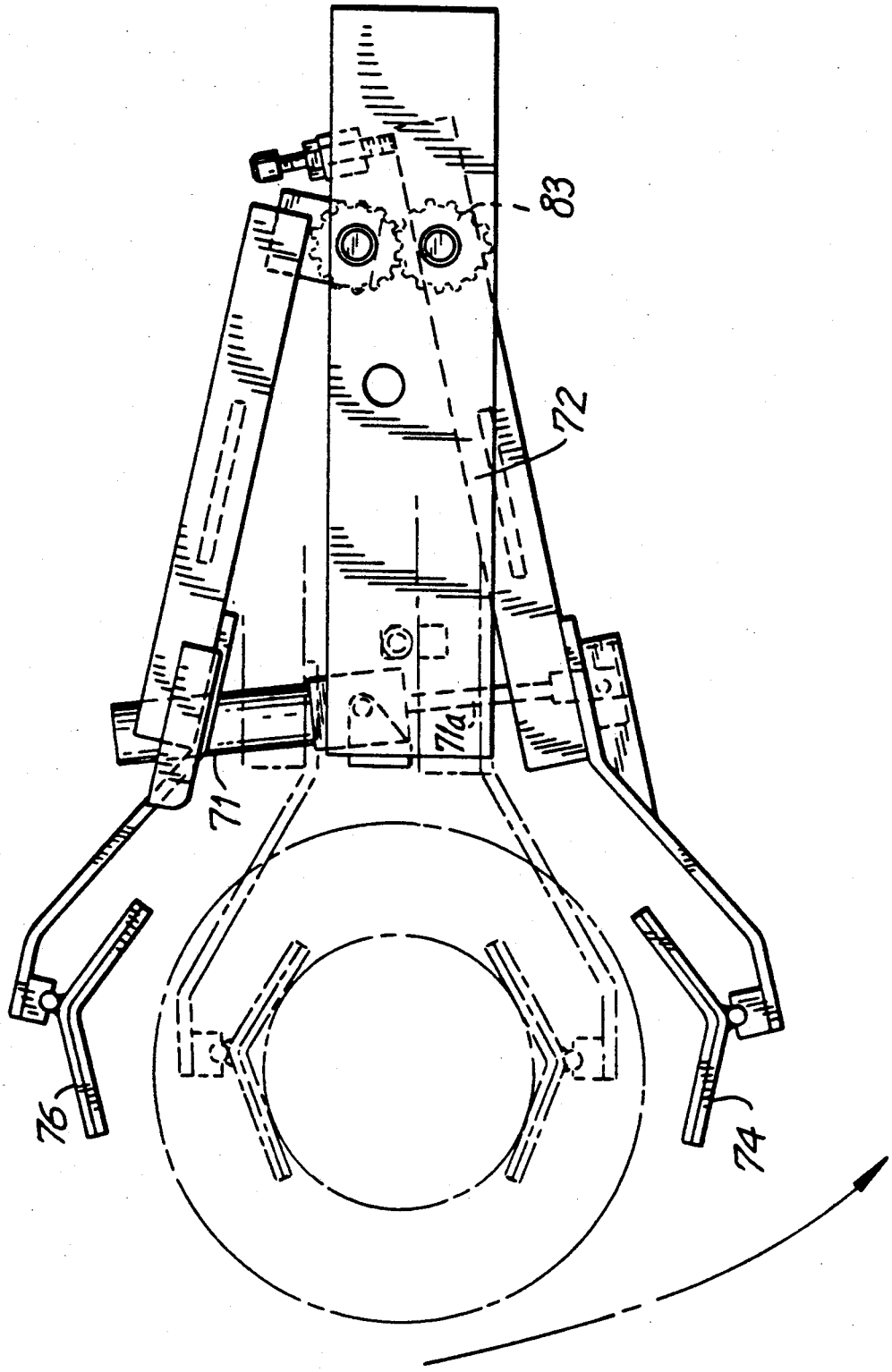
FIG. 14 is a side view of the reel take-off robotic arm constructed according to the invention.

When the full amount of a predetermined length of wire is wound about the reel at the nine o'clock position, a finger and knife assembly—shown in FIGS. 1 and 13—is rotated by the action of piston assembly 69 such that the knife 66 engages the wire 11, at the same time pushing it into the path of the snagger of the empty reel which has just moved to the twelve o'clock position from the three o'clock position. At this location, the core of the empty reel is accelerated to line speed which is leaving the supply barrel (not shown). In pushing the wire into the path of the empty reel snagger, the finger and knife assembly 64 cooperates with U-shaped bars 65 mounted on the turret. As shown in FIG. 1, the assembly 64 comes down just on the same side of the bart 65 as the twelve o'clock reel. Because the wire is constrained to a path up and over the bart 65, the wire is not pushed into the path of the snagger on the reel at nine o'clock, but only into the path of the snagger of the reel at twelve o'clock. The wire 11, when snagged by the snagger 19, delivers a small amount with the hook where it is cut by the knife 66 when the cutter assembly 64 is rotated to the position shown at the left hand side of FIG. 13. A shock absorber 68 forms part of the knife assembly 64 to dampen the end movement of the knife. Guard plate 65*a* is provided to separate the loose end of wire on the full reel from the newly winding reel at twelve o'clock, to keep the loose end from becoming caught on that new reel. After the wire 11 is transferred by the hooking and cutting process thus described, the rotational speed of the new reel positioned at twelve o'clock is now dancer controlled to match the radial speed of the reel core with the linear speed of the feed stock, and a conventional guide sheaves 60, 62 are now synchronized with the new reel to distribute the feed stock back and forth along the reel while the full reel at the nine o'clock position is now slowed down.

Referring once again to FIG. 1, after the wire cutting operation takes place and the fully wound reel is at the nine o'clock position, a suitable adhesive is dispensed from dispenser 16 onto the free end of the wire. Thereafter, the adhesive is permitted to cure preferably by a suitable curing apparatus such as an ultra-violet light system shown schematically at 15, or alternative curing devices such as a heat gun or infra-red lamp. The final fully wound reel will then be delivered to the end user in the form of a compact wound reel. Alternative wire securing means may be utilized as by wrapping the wound reel with plastic wrap, cellophane, etc., not shown in the drawings.

The next time an empty reel is loaded into the twelve o'clock position preparatory to cutover, the full reel with secured end is moved to turret position six o'clock where "OUT-LOAD" robotic apparatus assembly 72 grasps the full reel with grippers 74 and 76 as shown. When the reel is at the six o'clock position both snagger hooks 19 are automatically opened to free the wire for removal of the fully wound reel. Referring to FIG. 3, the reel clamp pintle 96 will withdraw from the reel, and the out load robot 72 by action of robot control assembly 77 will move its reel away from its snagger approximately one inch to clear the pintle. Thereafter, out load robot 72 will rotate counterclockwise to a point just above the outfeed conveyor 78 where the grasp on the reel is released.

The process described is a continuing and sequential process and all that is required is an adequate supply of empty reels and wire to be wound about the empty reels. In essence, the empty reels are loaded onto the turret at the three o'clock position and they are 70–80 percent wound with wire when at the twelve o'clock position. Thereafter, the remaining amount of wire is wound when the reel is at the nine o'clock position, the completion of which automatically actuates the finger and knife assembly to cut the wire. The turret is further indexed so that the fully wound reel moves counterclockwise to the six o'clock position for unloading by the pneumatically controlled robot 72. Although the processing is essentially described with respect to a single reel, the process is actually continuous and sequential and requires that a reel is positioned at each of the respective clock positions mentioned wherein the appropriate procedure thus described will take place.

Referring now to FIG. 6, the in-load conveyor system and the out-load conveyor system will now be described. As the in-load conveyor 21 shown in FIG. 3 delivers empty reels to the turret 14 at the loading station i.e. (three o'clock), the automatic robotic gripping mechanism 51 shown in FIGS. 1, 6, 11 and 12 loads them onto the turret at the three o'clock position.

The specific operation of the robotic in-load mechanism used in this invention requires three positions of the robotic mechanism 51. A first position is removed from the conveyor and the turret to make room for an incoming reel. A second position is at the conveyor 21 for gripping an empty reel. The third position is at the turret for loading the reel. These three positions are reached by using an air cylinder and track arrangement 57, shown in FIG. 1, whereby the mechanism is moved among the positions along the track. This motion is transmitted through support member 61 to which robotic mechanism 51 is pivotally connected at 51*a*. The pivot point allows the reel to be lifted over the sides of the conveyor.

The gripper arms 53 are opened and closed through movement of linkage 59*a* disposed within cylinder 59 and connected to the end of one of arms 53. Coordinated movement of the arms is assured through use of gears 63.

In the case of the output conveyor 78 shown in FIG. 3, the robotic arm 72 is automatically positioned adjacent the fully wound reel at the six o'clock position. The grippers 74 and 76 are separated and thereafter actuated, by linkage 71*a* disposed within cylinder 71, to grip the fully wound reel. Thereafter, the robotic arm is rotated downwardly counterclockwise by air cylinder 73 as shown in FIG. 1 to deliver the fully wound reel to the output conveyor 78, which is driven by conveyor motor 79.

The significant speeds by which such wire winding devices must operate make it somewhat difficult for providing continuous and sequential loading, winding, transferring and unloading of such reels of wire. In particular, the process is somewhat delayed by the respective loading and the unloading of the empty and fully wound reels. The present invention is directed toward improving this procedure by providing a sequential and continuous loading, winding, and unloading process by dividing the individual steps into various and sequential procedural steps which may readily be performed on a circular rotating turret mechanism as shown and described. By dividing the steps in such manner on such rotating turret mechanism the reels are readily processed for winding with minimum interference between the various steps of the processes and with resultant minimum direction changes among the components of the apparatus. Thus, the apparatus of my invention provides a high speed reel winding procedure while subjecting the components to minimum wear.

I claim:

1. A power driven take-up apparatus for winding flexible reeling stock onto take-up reels which comprises:

a. a power driven turret member having a plurality of stations, each adapted for receiving and supporting a reel or spool about which flexible reeling stock is to be wound;

b. automatic means for automatically mounting and positioning a reel or spool at a first station corresponding to a predetermined rotational position of said turret member;

c. means for rotating said turret member so that said reel or spool is moved at least to a second position;

d. means for directing reeling stock to be wound onto said reel to a location adjacent said reel or spool when it is located at said second position;

e. means for rotating said reel or spool at two of said positions in a direction adapted for winding the reeling stock thereabout;

f. means for stopping rotation of said reel or spool after a predetermined amount of wire is wound thereabout; and g. automatic means for automatically removing said completely wound reel or spool from said turret member;

said apparatus being adapted for sequential mounting of reels or spools onto said turret member for winding flexible reeling stock thereabout to provide a substantially continuous sequential wire winding procedure, wherein said means for rotating said reel or spool at said two of said positions comprises a motor driven pulley and belt system arranged to selectively rotate each reel at said two of said positions of said turret member for winding the reeling stock around said reels or spools, said motor driven pulley and belt system comprises at least two power driven motors, each adapted to drive a separate system of pulleys and pulley driving belts, and each station on said turret member for receiving a take-up reel or spool has a rotatable shaft connected to at least two pulleys, and one of each said set of pulleys is adapted to be rotated by engagement of a pulley belt at a predetermined location corresponding to a turret member position.

2. The apparatus according to claim 1 wherein each pulley belt is positioned for respective engagement by a pulley when the turret member is located at one of a plurality of stations.

3. The apparatus according to claim 2 wherein said turret member has a circular configuration and is adapted to be rotated counterclockwise to a plurality of stations corresponding respectively to three o'clock, twelve o'clock, nine o'clock and six o'clock positions as viewed from the front of said turret member.

4. A power driven rotary apparatus for winding flexible reeling stock onto reels, which comprises:

power driven turret means having at least two stations, each adapted for receiving and supporting a reel about which flexible reeling stock is to be wound;

means for rotating the turret means such that each of said stations can be indexed to at least two positions at which operations can be performed on said reel, wherein flexible reeling stock can be wound about said reel at two of said at least two positions, and reels can be mounted on or removed from said stations at least at one position;

means for directing flexible reeling stock onto said reel when said reel is located at a first of said two positions at which flexible reeling stock is wound on the reel; and means for rotating the reel when it is located at each of said positions at which flexible reeling stock is to be wound, to wind the flexible reeling stock thereon, said means for rotating comprising independent and selectively operable rotating means such that each reel is driven by the same rotating means throughout every position at which flexible reeling stock is wound about that reel, but wherein different reels simultaneously at the at least two positions at which flexible reeling stock is wound are driven by different rotating means.

5. The apparatus according to claim 4, wherein said turret means has a generally circular configuration.

6. The apparatus according to claim 4, wherein said flexible reeling stock is wire.

7. The apparatus according to claim 4, wherein each station on said turret member for receiving a reel has a rotatable shaft with a pair of pulleys mounted thereon, a first one of the pulleys of each pair being connected in driving engagement to said shaft so that said shaft is positively rotated by engagement of a pulley belt with said first pulley when the station is at a position at which flexible reeling stock is wound, and said independent and selectively operable rotating means comprises at least two motors adapted to drive two systems of pulleys and pulley driving belts arranged to selectively rotate a reel or spool wherein each reel is rotated by the same system of pulley driving belts at every position where flexible reeling stock is wound about that reel.

8. The apparatus according to claim 7, further comprising at least one automatic means for mounting and removing empty and fully wound reels, respectively.

9. The apparatus according to claim 8, wherein each driving belt is engaged by one pulley at each of said stations when that station is at a position at which flexible reeling stock is to be wound.

10. The apparatus according to claim 9, wherein the reel at each station is driven by a different belt than the reel at each adjacent station.

11. The apparatus according to claim 10, wherein the pulleys at each station remain in driving engagement with said pulley belts over at least part of the path traveled by said pulleys when said station moves between positions where flexible reeling stock is to be wound.

12. The apparatus according to claim 11, wherein said turret means has four stations, and there are four positions including a reel loading position, a first winding position, a second winding position, and a reel removing position.

13. The apparatus according to claim 10, wherein the pulleys at each station remain substantially in driving engagement with said pulley belts over substantially all of the path traveled by said pulleys when said station moves between positions where flexible reeling stock is to be wound.

14. A method for winding flexible reeling stock onto takeup reels, which comprises:

rotating a turret member having at least two stations, each adapted for receiving and supporting a reel about which flexible reeling stock is to be wound, so that each station is indexed to at least two positions at which operations can be performed on said reel, wherein flexible reeling stock can be wound about said reel at two of said positions, and reels can be mounted on or removed from said turret member stations at least at one of said positions;

directing flexible reeling stock onto said reel when said reel is located at a first of said two positions at which flexible reeling stock is wound;

rotating said reel at each station when it is located at a position at which reeling stock is to be wound, in a direction adapted for winding the flexible reeling stock thereabout, by independent and selectively operable rotating means, such that each reel is driven by the same rotating means at every position at which flexible reeling stock is wound about that reel, but wherein different reels simultaneously at positions at which flexible reeling stock is wound are driven by different rotating means; and sequentially mounting said reels onto said turret member for winding flexible reeling stock thereabout to provide a substantially continuous sequential flexible reeling stock winding procedure.

15. The method according to claim 14, wherein each station on said turret member for receiving a reel has a rotatable shaft with at least two pulleys mounted thereon, one of said pulleys being connected in driving engagement to said shaft and adapted to be rotated by engagement of a pulley belt when the station is at a position at which flexible reeling stock is wound, and further comprising the step of driving at least two systems of pulleys and pulley driving belts using independent and selectively operable motors, said systems of pulleys and pulley driving belts arranged to selectively rotate reels wherein each reel is rotated by the same system of pulley driving belts throughout every position where flexible reeling stock is wound about that reel.

16. The method according to claim 15, further comprising the steps of automatically mounting and removing empty and fully wound reels, respectively.

17. The method according to claim 16, further comprising driving the reels at each station by a different motor and system of pulleys and belts than the reels at each adjacent station.

18. The method according to claim 17, further comprising drivingly engaging the pulleys at each station with said pulley belts over at least part of the path traveled by said pulleys when said station moves between positions where flexible reeling stock is to be wound.

19. The method according to claim 18, further comprising drivingly engaging the pulleys at each station with said pulley belts over substantially all of the path travel by said pulleys when said station moves between positions where flexible reeling stock is to be wound.

20. The method according to claim 19, wherein said turret means has four stations, and further comprising rotating said four stations through four positions including a reel loading position, a first winding position, a second winding position, and a reel removing position.

* * * * *